US007233339B2

(12) United States Patent
Bae et al.

(10) Patent No.: US 7,233,339 B2
(45) Date of Patent: Jun. 19, 2007

(54) METHOD AND APPARATUS FOR PERFORMING DITHERING

(75) Inventors: Cheon-Ho Bae, Yongin-si (KR); Yong-Sub Kim, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 175 days.

(21) Appl. No.: 10/897,100

(22) Filed: Jul. 23, 2004

(65) Prior Publication Data

US 2005/0021579 A1 Jan. 27, 2005

(30) Foreign Application Priority Data

Jul. 26, 2003 (KR) ..... 10-2003-0051757

(51) Int. Cl.
*G09G 5/02* (2006.01)

(52) U.S. Cl. ..... 345/596; 345/605; 345/694; 358/3.13; 358/3.14; 358/3.16; 358/3.18

(58) Field of Classification Search ..... None
See application file for complete search history.

(56) References Cited

U.S. PATENT DOCUMENTS 4,924,301 A * 5/1990 Surbrook ..... 358/534
5,264,840 A * 11/1993 Wells et al. ..... 345/599
6,094,187 A * 7/2000 Jones et al. ..... 345/690
6,469,708 B1 * 10/2002 Wu et al. ..... 345/596
6,982,722 B1 * 1/2006 Alben et al. ..... 345/596
7,085,016 B2 * 8/2006 Lu et al. ..... 358/3.13
2002/0024527 A1 * 2/2002 Kawahara et al. ..... 345/596
2003/0026500 A1 * 2/2003 Hersch et al. ..... 382/293
2006/0256142 A1 * 11/2006 Sagano et al. ..... 345/690

FOREIGN PATENT DOCUMENTS

JP 07-160217 6/1995
KR 2000-0020842 4/2000
KR 10-2001-0039182 5/2001

* cited by examiner

*Primary Examiner*—Mark Zimmerman
*Assistant Examiner*—Jwalant Amin
(74) *Attorney, Agent, or Firm*—Harness, Dickey & Pierce, PLC

(57) ABSTRACT

A method and apparatus for dithering may provide filtering M bit data and performing a temporal/spatial compensation based on LSB of the filtered M bit data. The dithering may be performed on a selected frame. M-2 bits of the M bit data may be specified as a reference gray scale value resulting from the filtered M bit data. Temporal compensation may provide adding a weight of '0' or '1' to the reference gray scale value, for example M-2 bit data. Spatial compensation may include horizontal or vertical mirroring, and may be performed to represent whole gray scales without saturation.

32 Claims, 9 Drawing Sheets

| 8BIT INPUT DATA | | FILTERED OUTPUT DATA | | | | WEIGHT | | | | | | | |
|---|---|---|---|---|---|---|---|---|---|---|---|---|---|
| | | FIRST FRAME GROUP | | SECOND FRAME GROUP | | FIRST FRAME GROUP | | | | SECOND FRAME GROUP | | | |
| DECIMAL VALUE | BINARY VALUE | MSB 6BIT | LSB 2BIT | MSB 6BIT | LSB 2BIT | A FIRST FRAME | A SECOND FRAME | A THIRD FRAME | A FOURTH FRAME | A FIRST FRAME | A SECOND FRAME | A THIRD FRAME | A FOURTH FRAME |
| 0 | 0000 0000 | 00 0000 | 00 | 00 0000 | 00 | – | – | – | – | – | – | – | – |
| 1 | 0000 0001 | 00 0000 | 01 | 00 0000 | 00 | – | – | – | +1 | – | – | – | – |
| 2 | 0000 0010 | 00 0000 | 00 | 00 0000 | 10 | – | – | – | – | +1 | – | +1 | – |
| 3 | 0000 0011 | 00 0000 | 01 | 00 0000 | 10 | – | – | – | +1 | +1 | – | +1 | – |
| 4 | 0000 0100 | 00 0000 | 10 | 00 0000 | 10 | +1 | – | +1 | – | +1 | – | +1 | – |
| 5 | 0000 0101 | 00 0000 | 11 | 00 0000 | 10 | +1 | +1 | +1 | – | +1 | – | +1 | – |
| 6 | 0000 0110 | 00 0000 | 11 | 00 0000 | 11 | +1 | +1 | +1 | – | +1 | +1 | +1 | – |
| 7 | 0000 0111 | 00 0001 | 00 | 00 0001 | 00 | – | – | – | – | – | – | – | – |
| 8 | 0000 1000 | 00 0001 | 01 | 00 0001 | 01 | – | – | – | +1 | – | – | – | +1 |
| | | | | | • • • | | | | | | | | |
| 248 | 1111 1000 | 11 1101 | 01 | 11 1101 | 01 | – | – | – | +1 | – | – | – | +1 |
| 249 | 1111 1001 | 11 1101 | 10 | 11 1101 | 10 | +1 | – | +1 | – | +1 | – | +1 | – |
| 250 | 1111 1010 | 11 1101 | 11 | 11 1101 | 11 | +1 | +1 | +1 | – | +1 | +1 | +1 | – |
| 251 | 1111 1011 | 11 1110 | 00 | 11 1110 | 00 | – | – | – | – | – | – | – | – |
| 252 | 1111 1100 | 11 1110 | 01 | 11 1110 | 01 | – | – | – | +1 | – | – | – | +1 |
| 253 | 1111 1101 | 11 1110 | 10 | 11 1110 | 10 | +1 | – | +1 | – | +1 | – | +1 | – |
| 254 | 1111 1110 | 11 1110 | 11 | 11 1110 | 11 | +1 | +1 | +1 | – | +1 | +1 | +1 | – |
| 255 | 1111 1111 | 11 1111 | 00 | 11 1111 | 00 | – | – | – | – | – | – | – | – |

FIG.1
(CONVENTIONAL ART)

| TRUNCATION METHOD | | | | | |
|---|---|---|---|---|---|
| 8BIT INPUT DATA | | | 6BIT OUTPUT DATA | | REMARKS |
| DECIMAL VALUE | BINARY VALUE | | DECIMAL VALUE | BINARY VALUE | |
| 0 | 0000 0000 | ➡ | 0 | 00 0000 | SAME GRAY SCALE |
| 1 | 0000 0001 | | | 00 0000 | |
| 2 | 0000 0010 | | | 00 0000 | |
| 3 | 0000 0011 | | | 00 0000 | |
| 4 | 0000 0100 | ➡ | 1 | 00 0001 | SAME GRAY SCALE |
| 5 | 0000 0101 | | | 00 0001 | |
| 6 | 0000 0110 | | | 00 0001 | |
| 7 | 0000 0111 | | | 00 0001 | |
| ⋮ | | | | | |
| 248 | 1111 1000 | ➡ | 62 | 11 1110 | SAME GRAY SCALE |
| 249 | 1111 1001 | | | 11 1110 | |
| 250 | 1111 1010 | | | 11 1110 | |
| 251 | 1111 1011 | | | 11 1110 | |
| 252 | 1111 1100 | ➡ | 63 | 11 1111 | SAME GRAY SCALE |
| 253 | 1111 1101 | | | 11 1111 | |
| 254 | 1111 1110 | | | 11 1111 | |
| 255 | 1111 1111 | | | 11 1111 | |

FIG.2
(CONVENTIONAL ART)

| 8BIT INPUT DATA | | FILTERED OUTPUT DATA | | WEIGHT | | | | 6BIT OUTPUT DATA |
|---|---|---|---|---|---|---|---|---|
| DECIMAL VALUE | BINARY VALUE | MSB 6BIT | LSB 2BIT | A FIRST FRAME | A SECOND FRAME | A THIRD FRAME | A FOURTH FRAME | |
| 0 | 0000 0000 | 00 0000 | 00 | – | – | – | – | MSB6 BIT+WEIGHT |
| 1 | 0000 0001 | 00 0000 | 01 | – | – | – | +1 | |
| 2 | 0000 0010 | 00 0000 | 10 | +1 | – | +1 | – | |
| 3 | 0000 0011 | 00 0000 | 11 | +1 | +1 | +1 | – | |
| 4 | 0000 0100 | 00 0001 | 00 | – | – | – | – | |
| 5 | 0000 0101 | 00 0001 | 01 | – | – | – | +1 | |
| 6 | 0000 0110 | 00 0001 | 10 | +1 | – | +1 | – | |
| 7 | 0000 0111 | 00 0001 | 11 | +1 | +1 | +1 | – | |
| 8 | 0000 1000 | 00 0010 | 00 | – | – | – | – | |
| ⋮ | | | | | | | | |
| 248 | 1111 1000 | 11 1110 | 00 | – | – | – | – | |
| 249 | 1111 1001 | 11 1110 | 01 | – | – | – | +1 | |
| 250 | 1111 1010 | 11 1110 | 10 | +1 | – | +1 | – | |
| 251 | 1111 1011 | 11 1110 | 11 | +1 | +1 | +1 | – | |
| 252 | 1111 1100 | 11 1111 | 00 | – | – | – | – | NO CHANGE IN GRAY SCALE (OVERFLOW OCCURS) |
| 253 | 1111 1101 | 11 1111 | 01 | – | – | – | +1 | |
| 254 | 1111 1110 | 11 1111 | 10 | +1 | – | +1 | – | |
| 255 | 1111 1111 | 11 1111 | 11 | +1 | +1 | +1 | – | |

FIG.5

| 8BIT INPUT DATA | | FILTERED OUTPUT DATA | | | | WEIGHT | | | | | | | |
|---|---|---|---|---|---|---|---|---|---|---|---|---|---|
| | | FIRST FRAME GROUP | | SECOND FRAME GROUP | | FIRST FRAME GROUP | | | | SECOND FRAME GROUP | | | |
| DECIMAL VALUE | BINARY VALUE | MSB 6BIT | LSB 2BIT | MSB 6BIT | LSB 2BIT | A FIRST FRAME | A SECOND FRAME | A THIRD FRAME | A FOURTH FRAME | A FIRST FRAME | A SECOND FRAME | A THIRD FRAME | A FOURTH FRAME |
| 0 | 0000 0000 | 00 0000 | 00 | 00 0000 | 00 | – | – | – | – | – | – | – | – |
| 1 | 0000 0001 | 00 0000 | 01 | 00 0000 | 00 | – | – | – | +1 | – | – | – | – |
| 2 | 0000 0010 | 00 0000 | 00 | 00 0000 | 10 | – | – | – | – | +1 | – | +1 | – |
| 3 | 0000 0011 | 00 0000 | 01 | 00 0000 | 10 | – | – | – | +1 | +1 | – | +1 | – |
| 4 | 0000 0100 | 00 0000 | 10 | 00 0000 | 10 | +1 | – | +1 | – | +1 | – | +1 | – |
| 5 | 0000 0101 | 00 0000 | 11 | 00 0000 | 10 | +1 | +1 | +1 | – | +1 | – | +1 | – |
| 6 | 0000 0110 | 00 0000 | 11 | 00 0000 | 11 | +1 | +1 | +1 | – | +1 | +1 | +1 | – |
| 7 | 0000 0111 | 00 0001 | 00 | 00 0001 | 00 | – | – | – | – | – | – | – | – |
| 8 | 0000 1000 | 00 0001 | 01 | 00 0001 | 01 | – | – | – | +1 | – | – | – | +1 |
| | | | | | • • • | | | | | | | | |
| 248 | 1111 1000 | 11 1101 | 01 | 11 1101 | 01 | – | – | – | +1 | – | – | – | +1 |
| 249 | 1111 1001 | 11 1101 | 10 | 11 1101 | 10 | +1 | – | +1 | – | +1 | – | +1 | – |
| 250 | 1111 1010 | 11 1101 | 11 | 11 1101 | 11 | +1 | +1 | +1 | – | +1 | +1 | +1 | – |
| 251 | 1111 1011 | 11 1110 | 00 | 11 1110 | 00 | – | – | – | – | – | – | – | – |
| 252 | 1111 1100 | 11 1110 | 01 | 11 1110 | 01 | – | – | – | +1 | – | – | – | +1 |
| 253 | 1111 1101 | 11 1110 | 10 | 11 1110 | 10 | +1 | – | +1 | – | +1 | – | +1 | – |
| 254 | 1111 1110 | 11 1110 | 11 | 11 1110 | 11 | +1 | +1 | +1 | – | +1 | +1 | +1 | – |
| 255 | 1111 1111 | 11 1111 | 00 | 11 1111 | 00 | – | – | – | – | – | – | – | – |

FIG.7

| MIRRORED FORM | LSB 2-BIT | nth FRAME | (n+1)th FRAME | (n+2)th FRAME | (n+3)th FRAME |
|---|---|---|---|---|---|
| REFERENCE FORM | 01 | O E<br>mth LINE<br>(m+1)th LINE<br>(m+2)th LINE<br>(m+3)th LINE | | | |
| | 10 | | | | |
| | 11 | | | | |
| VERTICAL MIRRORING | 01 | | | | |
| | 10 | | | | |
| | 11 | | | | |
| HORIZONTAL MIRRORING | 01 | | | | |
| | 10 | | | | |
| | 11 | | | | |

■ +1 O : ODD-NUMBERED PIXEL
□ +0 E : EVEN-NUMBERED PIXEL

METHOD AND APPARATUS FOR PERFORMING DITHERING

CROSS REFERENCE TO RELATED APPLICATION

This application claims priority under 35 USC § 119 to Korean Patent Application No. 2003-51757, filed on Jul. 26, 2003, the contents of which are herein incorporated by reference in their entirety.

BACKGROUND OF THE INVENTION

1. Field of the Invention

The present invention relates to a method and apparatus for dithering in an image-displaying device, where the dithering may provide representation of whole gray scales without saturation.

2. Description of the Related Art

Image-displaying devices for example, CRT display, TFT-LCD, and printers, have previously been developed. Displaying images may be divided into processes, which may include digitization of a real image for performing image processing, and displaying the processed signal through an image-display device. An image-displaying device may provide an image similar to a corresponding real image based on a series of processes. Data loss may be reduced during the digitization process of a real image, and the data loss which may occur due to the processing of the image, may also be reduced. The digitization process of a real image may include a series of sampling processes, for example quantization, and/or standardization, and may include signal transactions, which may occur in the digitization process. One goal of the digitization process may be to process a digital image as close as possible to the corresponding real image, while reducing data loss that may occur.

An image-displaying device may be used to display a processed image to the viewing characteristics of a corresponding user, and may be limited by this display requirement. An image-displaying device may be limited in the area of displaying gray scales. An example of displaying gray scales may be recognized when R (Red), G (Green), and B (Blue) 8-bit input data, and 8-bit gray scales are converted to a smaller bit scale. For example, input data may be represented by $2^8$ gray scales, thus color combinations of R, G and B, $2^8 \times 2^8 \times 2^8$ may result in $2^{24}$ colors. When an image-display device converts 8-bit data to 6-bit data, a corresponding gray scale conversion $2^8-2^6$ may not include each input data, similarly all of the original colors may not be expressed. Therefore, when an image-displaying device processes a signal by reducing gray scales to a level below the full gray scales of the corresponding original video signal, inputting noise to the image data (or 'dithering') may be used to provide an original image restoration process.

Each pixel may include three sub-pixels, for example R, G and B, and/or input data may be applied to each of these sub-pixels. If input data applied to the sub-pixels includes a reduction in the number of gray scales then a false contour line representing a definite contour line shown at the boundaries of an image, or Mach's phenomenon representing a bright band or dark band shown at the surface of screen may occur.

The false contour line or Mach's phenomenon may generate a contour line that does not exist in the real image, thus lowering the quality of an image displayed. Therefore, dithering, which may include inputting noise to pixels at the boundaries of images, may be used to avoid this type of false contour line. When for example, a bit width at a video source is larger than the bit width at an image-display device, then dithering may provide an increase in quality for that image-display device.

A type of dithering known as 'truncation' may be used to improve the quality of an image-display device. Truncation may include removing bits from a set of input data by removing the LSB (Least Significant Bit(s)), for example, 2 bits may be removed from an 8-bit signal, and the remaining 6-bit signal may be output to a pixel. When the remaining 6-bit signal is output to the pixel, the gray scales of one sub-pixel may be equal to $2^6$ for showing the boundaries of an image.

FIG. '1' illustrates an example of a truth table according to a conventional truncation method. Referring to FIG. 1, when input data provided by an 8-bit signal is represented with 6 bits, decimal values 0, 1, 2, and 3 for example may be converted to '0', and decimal values of 4, 5, 6 and 7 may be converted to '1'. These converted values may be outputted to display an image on a screen, which may have a false contour line non-existent in the real image.

Another type of dithering is referred to as temporal/spatial or 'temporal' compensation. 8-bit input data may be converted to 6-bit output data by temporal compensation. Temporal compensation may provide the removal of 2 bits, 2 LSBs for example, from the 8-bit input data. Temporal compensation may be performed on each frame of output data received based on the 2 LSBs removed. In spatial compensation, each output data frame may be compensated based on the 2 LSBs removed, by considering the line and pixel locations in each output data frame. Therefore 8-bit output data that has been converted to 6-bit data, may be approximated by using 6-bit temporal/spatial compensation on the output data. The lines and pixels in each output data frame may be compensated by a weight which corresponds to the 2 LSBs of the 8-bit input data.

Table '1' is an example of temporal/spatial compensation based on 2 LSBs.

TABLE 1

| LSB 2 bit | A first frame | A second frame | A third frame | A fourth frame |
|---|---|---|---|---|
| 00 | — | — | — | — |
| 01 | — | — | — | +1 |
| 10 | +1 | — | +1 | — |
| 11 | +1 | +1 | — | +1 |

Referring to Table 1, the (MSB) 6-bit data may be outputted without adding a weight, or may be summed with a weight of 1. The 6-bit data may be outputted to one pixel based on 2 LSBs of data from respective output data frames. For example, when 2 LSBs of data are removed from 8-bit data during a time period corresponding to four frames of data, and the data is equal to '11', then the output data may lose 3 sets of LSBs '11'×4 frames resulting in a value of 12 . The lost value may be compensated by:

adding +1('100') to the 6 MSBs of a corresponding pixel in a first frame, adding +1 to the 6 MSBs of the corresponding pixel in a second frame, outputting 6 MSBs of the corresponding pixel in a third frame without change, and adding +1 to the 6 MSBs of the corresponding pixel in a fourth frame.

The compensation may further include four frames of ('100')×3 (3 being the number of frames to which '1' is added), i.e. a value of 12 may be compensated so that the value lost during a time period corresponding to four frames and the compensated value are the same.

When the 2 LSBs are for example '10', the lost value during a time period corresponding to four frames may be represented by 2 LSBs '10'×four frames, resulting in 8 bits.

The lost value may be compensated by:

adding +1('100') to 6 MSBs of a corresponding pixel in a first frame, outputting 6 MSBs of the corresponding pixel in a second frame without change, adding +1 to 6 MSBs of the corresponding pixel in a third frame, and outputting 6 MSBs of the corresponding pixel in a fourth frame without change.

Temporal/spatial compensation may not be limited to selecting a frame and adding a weight to the frame selected. For example, when the 2 LSBs are '11' a weight may be added to a pixel corresponding to three frames among four continuous frames, and when the 2 LSBs are '10', a weight may be added to a pixel corresponding to the two frames among four continuous frames.

FIG. 2 is an exemplary truth table of a conventional temporal/spatial compensation for 8-bit input data.

Referring to FIG. 2, 8-bit input data having corresponding gray scale values equal to or greater than '252' may not change.

FIG. 3 is a graph illustrating exemplary output characteristics according to a conventional temporal/spatial compensation.

Referring to FIG. 3, the output data may be saturated to a specific value irrespective of a change to the input data illustrated in FIG. 2.

Therefore, a conventional dithering process based on conventional temporal/spatial compensation, may not provide an expression of input data for representing a high level of brightness.

SUMMARY OF THE INVENTION

The present invention provides a method of performing dithering and an apparatus for performing the same, which may represent whole gray scales without saturation. An exemplary embodiment of the present in invention provides a method of performing dithering, which may include selecting a frame on which dithering will be performed; filtering M1 bit data based on at least two frame group conditions to represent a gray scale with M2 bits, where M2 being obtained by subtracting N from M1; selecting un upper M2 bits from the filtered M1 bit data to represent a reference gray scale value; selecting a dither matrix for the selected frame; and performing a temporal compensation or a spatial compensation on the selected dither matrix based on lower N bits of the filtered M1 bit data.

Another exemplary embodiment of the present invention may provide an apparatus for performing dithering, which may include an n-bit frame counter configured to select continuous $2^n$ frames on which dithering is performed, and count a vertical synchronization signal to select a dither matrix, and an m-bit line counter configured to count a data enable signal based on the vertical synchronization signal to select $2^m$ lines of the dither matrix on which a spatial compensation is performed. The apparatus may also include at least one filter configured to filter M1 bit data based on the data enable signal according to at least two frame group conditions, a pixel counter configured to select an odd-numbered pixel or an even-numbered pixel of the dither matrix based on a system clock and the data enable signal, and at least one dither matrix selecting section configured to perform the dithering on the filtered M1 bit data to obtain M2 bit data for representing a gray scale based on the filtered M1 bit data, an output of the n-bit frame counter, an output of the m-bit line counter and an output of the pixel counter.

BRIEF DESCRIPTION OF THE DRAWINGS

Exemplary embodiments of the present invention will become more apparent by describing in detail exemplary embodiments thereof with reference to the attached drawings in which:

FIG. '1' illustrates an exemplary truth table according to a conventional truncation method of dithering.

FIG. 2 illustrates an exemplary truth table according to a conventional temporal/spatial compensation method for dithering 8-bit input data.

FIG. 5 is a truth table illustrating a dithering method according to an exemplary embodiment of the present invention.

FIG. 7 is a schematic view illustrating a mirroring operation performed on a selected dither matrix according to an exemplary embodiment of the present invention.

DETAILED DESCRIPTION OF EXEMPLARY EMBODIMENTS OF THE PRESENT INVENTION

Exemplary embodiments of the present invention will now be described more fully with reference to the accompanying drawings, in which exemplary embodiments of the invention are shown.

Figure 3:
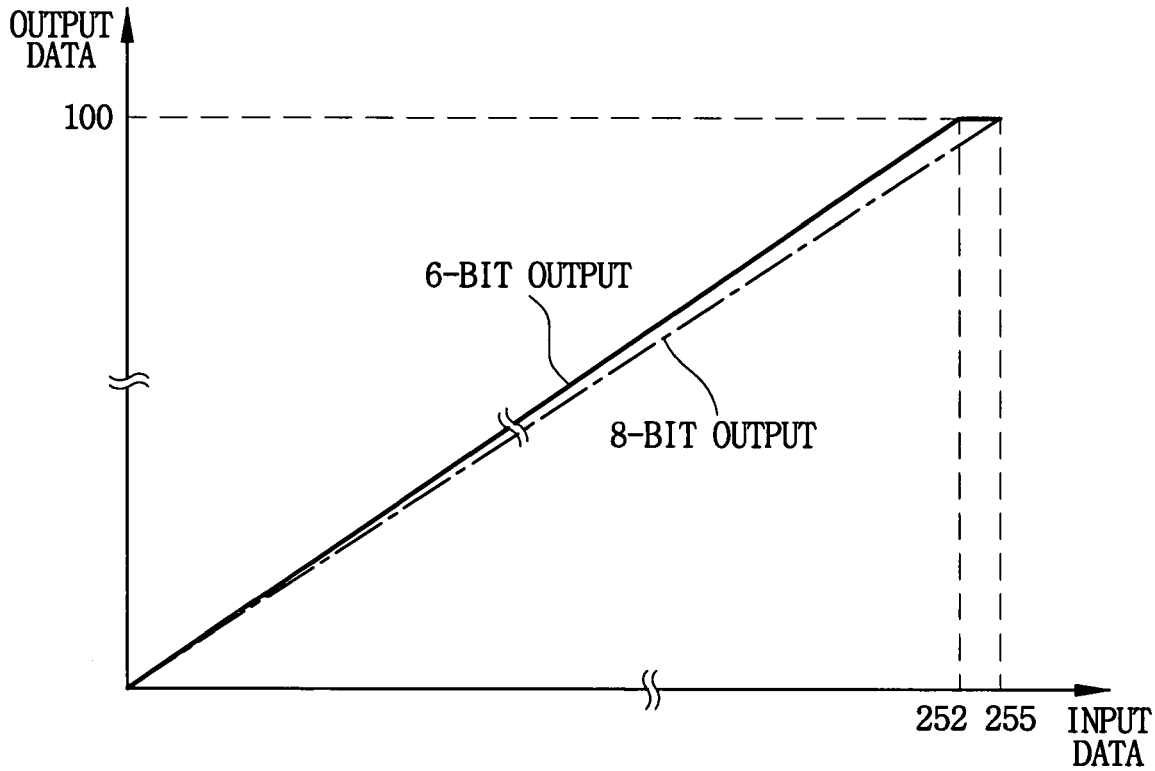
FIG.3 (CONVENTIONAL ART)
FIG. 3 is a graph illustrating output characteristics based on a conventional temporal/spatial compensation.
Figure 4:
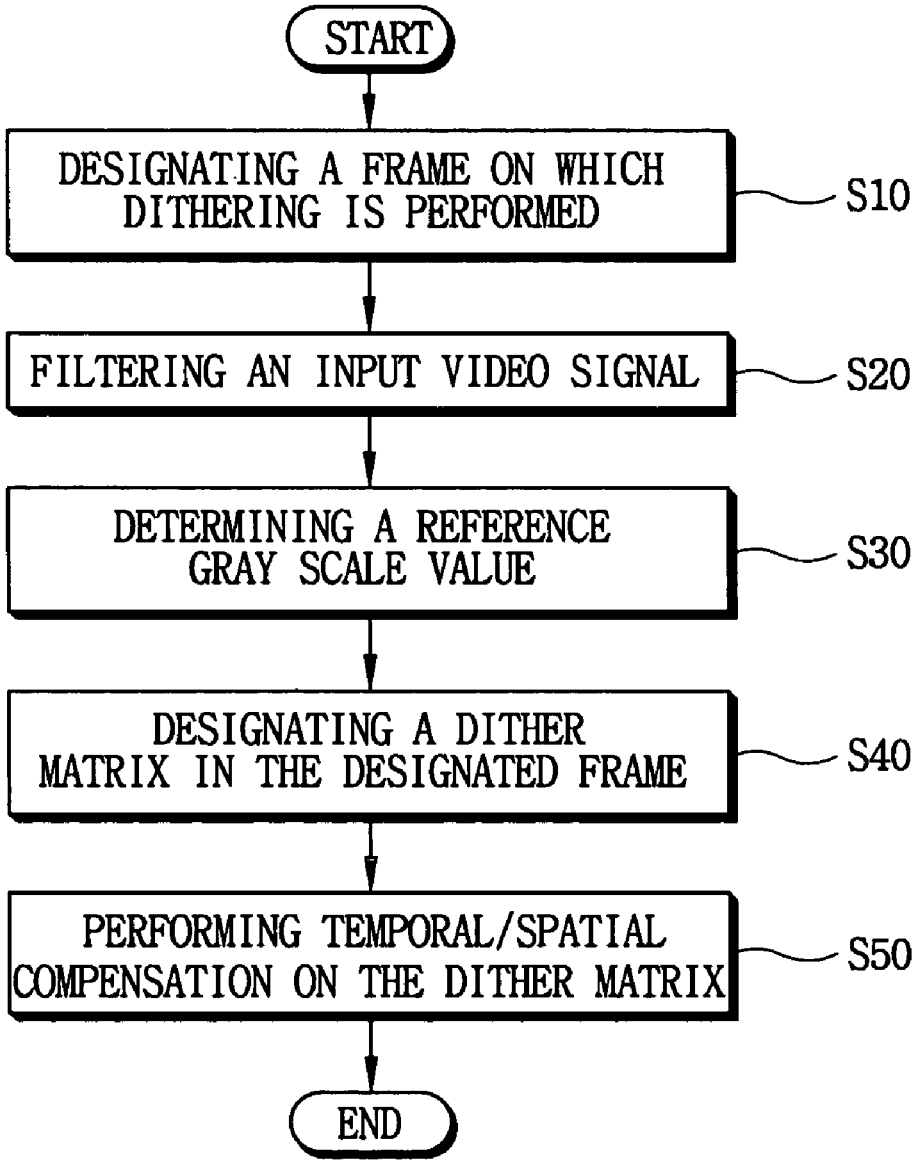
FIG. 4 is a flowchart illustrating a dithering method according to an exemplary embodiment of the present invention.

FIG. 4 is a flowchart illustrating a method of performing dithering according to an exemplary embodiment of the present invention.

Referring to FIG. 4, dithering is performed on a designated frame (S10). Frames may be designated for example, as a set of two, four or more continuous frames. Performing dithering on two designated frames may reduce flicker, which is a phenomenon in which a bright image and a dark image are displayed alternately on a display screen, and which may be due to poor or incorrect restoration of images. M number of data bits may be received and filtered based on the at least two frame group conditions so that the respective M bit data may be represented by M-2 bits of gray scales (S20). Upper M-2 bits of the filtered M bit data may be selected and/or determined as a reference gray scale value (S30). S30 and S40 of FIG. 4 are described below in greater detail.

The number of data bits M for example, may correspond to two or four continuous frames, which may be designated as a frame group, however the number of frames designated as a frame group may not be limited to only two or four, thus a frame group may contain a different number of frames. Input data having M bits, may be filtered based on at least one frame group condition so that the M-2 bits may represent whole gray scales.

For more than one frame group condition, a bit value of the input data may decrease by a decimal value of '3' for example, when the input data has a gray scale corresponding to a high level of brightness, and/or a bit value of the input data may decrease by a decimal value 0, 1, or 2 for example, when the input data has a gray scale corresponding to a low level of brightness.

For example two frame group conditions may include a first frame group condition that satisfies the following relationships:

$$Din>g \rightarrow Dout=Din-3$$

$$g \geqq Din>h \rightarrow Dout=Din-2$$

$$Din \leqq h \rightarrow Dout=Din,\ (2^M-4>g>h>0,\ g \text{ and } h \text{ are integers})$$

and a second frame group condition that satisfies these following relationships:

$$Din>g \rightarrow Dout=Din-3$$

$$g \geqq Din>h \rightarrow Dout=2$$

$$Din \leqq h \rightarrow Dout=0,\ (2^M-4>g>h>0,\ g \text{ and } h \text{ are integers}).$$

Input data may provide for example, a group of 8 bits, 10 bits, and may provide more or less bits depending upon the data group size specified. Hereinafter, the input data will be referred to for example purposes, as being a group of 8 bits. Input data may be filtered for example, based on two frame group conditions. A reference gray scale may be then designated as corresponding to MSBs 6 bit of the filtered 8-bit input data.

Dithering may be performed on a different number of designated frames, for example two or more. M-bit data may be filtered based on a first frame group condition during a first time period, and may correspond to two or more designated frames. The filtering may also be based on a second frame group condition during a second time period, which may correspond to two or more designated frames following the first time period. Another filtering option may include filtering the M-bit data by applying a first frame group condition to two first designated frames, and may further include filtering by applying a second frame group condition to two second designated frames following the two first designated frames.

A dither matrix may be selected for a designated frame on which dithering may be performed (see S40 of FIG. 4). The dither matrix may have 8 pixels represented by a form of 2 rows and 4 columns or 4 columns and 2 rows, for example. If a dither matrix has a form of 4×2 then 4 pixel lines may need to be selected, which may include selecting odd-numbered and/or even-numbered pixels of a dither matrix.

A temporal/spatial compensation may be performed on the dither matrix based on a lower 2 bits of filtered M-bit data.

FIG. 5 is an example truth table illustrating a dithering method according to an exemplary embodiment of the present invention.

Referring to FIG. 5, a filtering process may be performed for an 8-bit input data, and two frame group conditions 'g' and 'h' may be used. An example may be that 'g'=5 and 'h'=1, which represent two frame group conditions. The values of the frame group conditions 'g' and 'h' however, may also be represented by other values.

A first frame group may be designated as two or more continuous frames. As illustrated in FIG. 5, according to an exemplary embodiment of the present invention, a first frame group contains four continuous frames illustrated as first, second, third and fourth frames. If the input data is for example, '11111110' during a first time period corresponding to the four designated frames, then a first frame group condition may be applied to the input data, thus the filtered input data may be equal to '11111011' (by subtracting a decimal value of '3' from the binary input data based on the first frame group condition). Then the 6 MSBs of the filtered input data, i.e. '111110', may be designated as a gray scale reference for the value of a pixel in a corresponding dither matrix on which dithering may be performed.

Four continuous frames that may be different from the first frame group, may be designated as a second frame group. If the input data is for example '11111110' during a time period corresponding to the four designated frames of a second frame group then a second frame group condition may be applied to the input data so that the filtered input data may be equal to '11111011' (by subtracting a decimal value of '3' from the binary input data based on the second frame group condition). The 6 MSBs of the filtered input data in this example is '111110', which may be designated as a reference gray scale value of a pixel in a dither matrix on which dithering may be performed.

The remaining 2 LSBs of data '11' from the filtered input data may be reflected to a screen display by applying temporal/spatial compensation. The reference gray scale value increases by one to be outputted to 6 frames among continuous 8 frames according to the two corresponding frame groups. Alternately, instead of four continuous frames, two continuous frames may instead be designated as a first frame group, and two frames that are continuous with the first frame group may be designated as a second frame group, however a frame group may not be limited to two or four and may contain a different number of continuous frames.

Figure 6:
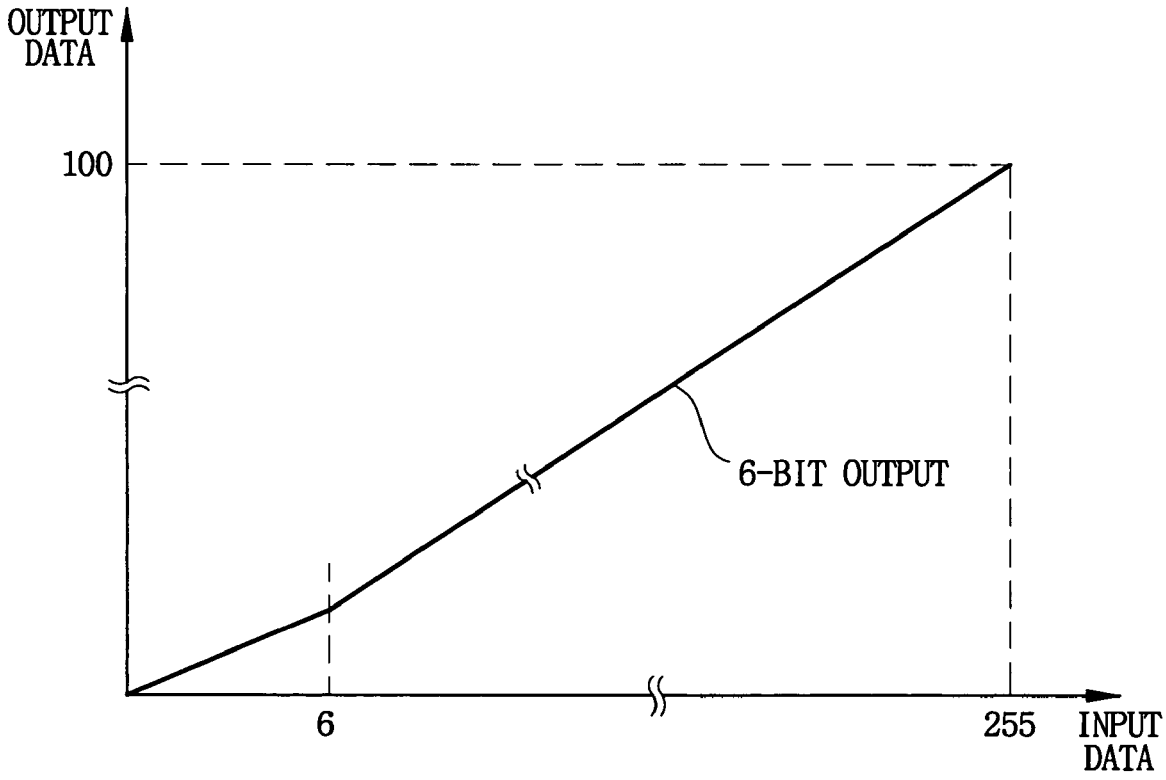
FIG. 6 is a graph illustrating output characteristics of the dithering method of FIG. 5.

FIG. 6 is a graph illustrating output characteristics of the example dithering method of FIG. 5.

The frame group conditions illustrated in the graph of FIG. 6 correspond to the frame group conditions of FIG. 5, and include an average output value for two or four continuous frames. The average output value may be standardized in a range from 0 to 100 for the output data.

Referring to FIG. 6, if frame group conditions are applied to the input data then saturation may not occur for gray scales corresponding to a high level of brightness. If the input data has gray scales corresponding to a low level of brightness then the input data may be represented by whole gray scales by performing temporal/spatial compensation.

Similar to temporal compensation, spatial compensation may be performed, and may include vertical mirroring and/or horizontal mirroring. Mirroring may provide an arbitrary image to a screen to be represented as a mirrored image. An example of mirroring may include an entire or partial image being rotated by 180 degrees with respect to an axis to display the mirror image.

FIG. 7 is a schematic view illustrating a method for performing mirroring on a dither matrix according to an exemplary embodiment of the present invention.

Referring to FIG. 7, a reference gray scale value of 8 pixels in a selected dither matrix may be determined. The reference gray scale value may vary with input data applied to the corresponding pixel. A weight may be added to a corresponding pixel based on 2 LSBs of the corresponding pixel, which may be different values even though the pixels may be in the same dither matrix. Hereinafter, for simplicity, the 2 LSBs for each of the pixels in the dither matrix may have the same value.

The reference gray scale value may be outputted to 8 pixels of a selected matrix without change when the 2 LSBs are equal to a binary value '00' for example.

When the 2 LSBs equal a binary value '01' for example, the reference gray scale value of an odd-numbered pixel in an arbitrary $m^{th}$ line of a corresponding dither matrix in an $n^{th}$ frame, may increase by a weight of '1'. The $n^{th}$ frame may be designated as part of the first frame group based on a first frame group condition. The reference gray scale value of an even-numbered pixel in a (m+2) line of the dither matrix in the $n^{th}$ frame may increase by a weight of '1', and the other remaining pixels may output a reference gray scale value without adding a weight to the pixels.

The dither matrix, included in an (n+1) frame designated in a first frame group, may provide a weight increase to the pixels to which the weight has not been applied in the nth frame. The pixels to which the weight has been applied in the nth frame may provide a reference gray scale value without adding weights in the (n+1) frame. As shown in FIG. 7, for example, a weight may be added to an odd-numbered 'O' pixel in the m+1 line of an n+1 frame, and may be added to an even-numbered 'E' pixel in the m+3 line of the n+1 frame.

The reference gray scale value of an even-numbered pixel in an arbitrary $m^{th}$ line of a dither matrix in the n+2 frame for example, may increase by a weight of '1', and the frame may be designated as a part of the second frame group based on a second frame group condition. The reference gray scale value of an odd-numbered pixel in the m+2 line of a dither matrix in the corresponding n+2 frame may increase by a weight of '1'. The other pixels of the n+2 frame may output the reference gray scale value of the input data without adding a weight.

Another dither matrix may be in the n+3 frame, designated as a second frame group. The dither matrix may provide a weight increase to the pixels to which the weight has not been applied in the (n+2) frame. The pixels to which the weight has been applied in the (n+2) frame may provide a reference gray scale value without adding weights in the (n+3) frame. FIG. 7 for example, provides a weight added to an even-numbered pixel in the m+1 line of the n+3 frame, and to an odd-numbered pixel in m+3 line of the n+3 frame. For example, two continuous frames may be designated as a first frame group based on a first frame group condition, and two other continuous frames, which may follow after the two first frames, may be designated as a second frame group based on a second frame group condition. For temporal compensation, when 2 LSBs of a pixel in a dither matrix equal a binary value '01' for example, a weight of '1' may be added to a corresponding pixel in one frame, during a time period corresponding to four continuous frames.

When 2 LSBs of a pixel in a dither matrix equal a binary value '10' for example, a weight of '1' may be added to a corresponding pixel in two frames during a time period corresponding to four continuous frames, and when 2 LSBs of a pixel in a dither matrix equal a binary value '11' for example, a weight of '1' may be added to a corresponding pixel in three frames during a time period corresponding to four continuous frames. However, the frame(s) to which the weight of '1' is added may be randomly selected.

The dither matrix to which the weight of '1' is added may be set as a reference form for spatial compensation. The spatial compensation may be performed based on the reference form, also vertical mirroring or horizontal mirroring compensation may also be performed based on the reference form.

Vertical mirroring for example, may be represented by rotating the reference form of a dither matrix by 180 degrees with respect to an axis that horizontally bisects the pixels of the dither matrix. Horizontal mirroring may be represented by rotating the reference form of a dither matrix by 180 degrees with respect to an axis that vertically intersects the odd and even numbered pixels of the dither matrix.

With respect to three signals, which may be applied to three sub-pixels respectively for example, R (Red), G (Green) and B (Blue) sub-pixels, horizontal mirroring and vertical mirroring may be performed alternately on the three signals. For example, horizontal mirroring may be performed on two of three signals every four frames, and vertical mirroring may be performed on the one remaining signal of the three signals of every four frames.

Two arbitrary signals, which may be applied to two sub-pixels, may provide a reference form output without change. For example, during a time period corresponding to four selected frames a horizontally mirrored form, of the reference form, may be output during another time period corresponding to four other frames, following the four selected frames. Another example may provide the reference form being output without change during another time period corresponding to four frames following the four frames of the horizontally mirrored form. Therefore a reference form and a horizontally mirrored form may be alternated in a repeated sequence every four frames.

For a signal applied to a remaining one sub-pixel, a reference form may be output without change during a time period corresponding to four selected frames, and a vertically mirrored form of the reference form may be output during another time period corresponding to another four frames following the four selected frames. The reference form may be output without change during another time period corresponding to another four frames following a previous four frames. Therefore, a reference form and a vertically mirrored form may be alternated in a repeated sequence every four frames.

Although different frame group conditions shown in the exemplary embodiments disclosed in this detailed description of the present invention, have been described for sets of two or four frames, the frame group conditions may alternately be applied to a different number of frames.

Exemplary embodiments of the present invention may further provide a method of performing dithering with separate frame group conditions. For example, input data having M bits may be filtered based on at least two frame group conditions, thus M-2 bits of the filtered input data may be used to represent whole gray scales.

The frame group conditions may have for example, four subsections, depending on the gray scale and corresponding level of brightness, however the frame group conditions may include more subsections representing a different number of brightness levels. The following example is based on frame group conditions having four subsections, where the bit value of one of the input signals may decrease by a decimal value 0, 1, 2 or 3 in proportion to the level of brightness in the respective subsections.

With regard to the frame group conditions, a first frame group condition may satisfy the following relationships:

$$Din<i \rightarrow Dout=Din$$

$i \leqq Din < j \rightarrow Dout = Din - 1$ $i \leqq Din < k \rightarrow Dout = Din - 2$ $Din \geqq k \rightarrow Dout = Din - 3$, ($2^M - 4 > k > j > i > 0$; $i$, $j$ and $k$ are integers) and, a second frame group condition may satisfy the following relationships, $Din < i+1 \rightarrow Dout = Din$ $i+1 \leqq Din < j+1 \rightarrow Dout = Din - 1$ $j+1 \leqq Din < k+1 \rightarrow Dout = Din - 2$ $Din \geqq k+1 \rightarrow Dout = Din - 3$, ($2^M - 4 > k > j > i > 0$; $i$, $j$ and $k$ are integers).

The input data M may include for example 8, 10 or more bits. Hereinafter, the input data have will be described as having 8 bits for simplification. When the 8-bit input data is filtered based on two frame group conditions, then the 6 MSBs, among the filtered 8-bit data, may be set as a reference gray scale value. The temporal/spatial compensation, including mirroring for example, may be performed on the dither matrix based on the 2 LSBsleft.

Figure 8:
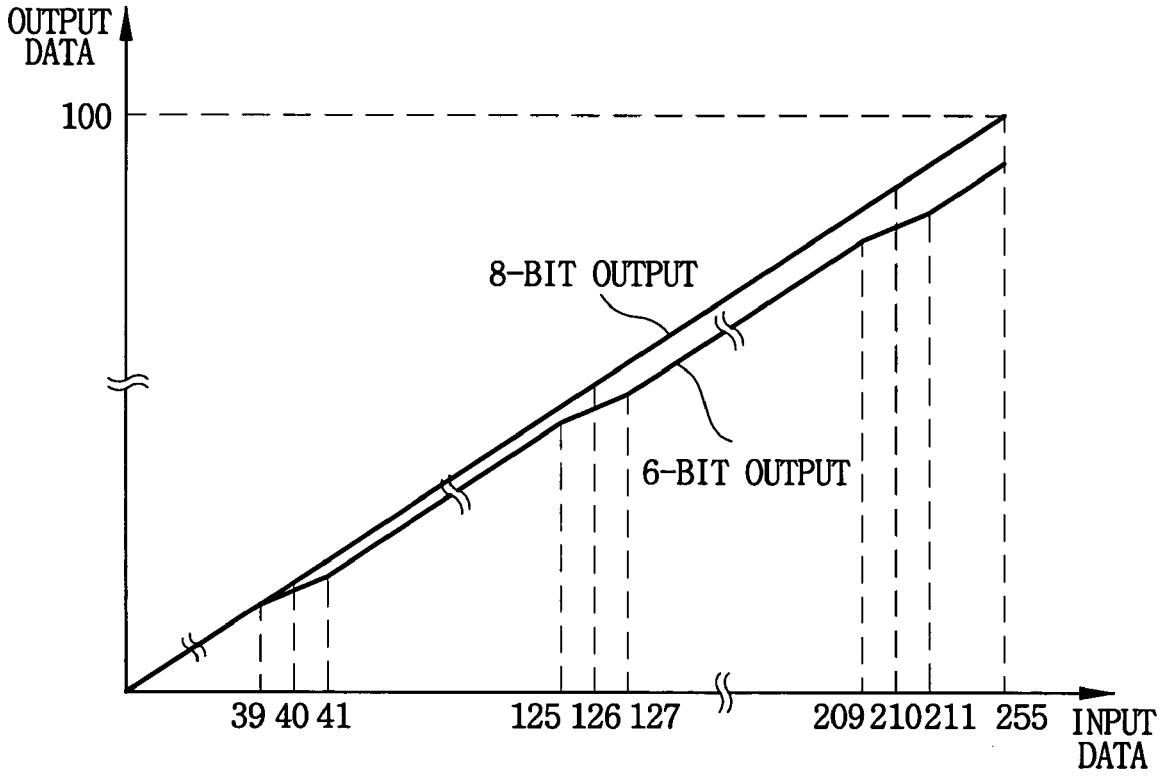
FIG. 8 is a graph illustrating output characteristics of dithering according to an exemplary embodiment of the present invention.

FIG. 8 is a graph illustrating output characteristics of a dithering operation, according to an exemplary embodiment of the present invention.

Referring to FIG. 8, i=40, j=126 and k=210 for example, however the values of i, j and k may be varied. According to a first frame group condition, when the input data, i.e. the decimal value of input data is 39, the output data may be 39, and when the decimal value of input data is 40, the output data may still be 39, thus because of this inconsistency in the data processing, the output data may not represent the entire gray scales. Similarly, when the decimal value of input data is 125 and 126, or 209 and 210, the output data may not represent the whole gray scales.

For the purpose of representing whole gray scales, the example boundary values (40, 126 and 210) of the four subsections may increase by '1' based on a frame group condition. When first and second group conditions may be applied to the input data in sequence, average output values of the boundary values (40, 126 and 210) may include a real number to express the whole gray scales. The two frame group conditions described may be replaced by additional frame group conditions.

An additional four frame group conditions may include, a third frame group condition that may satisfy the following relationships:

$Din < i \rightarrow Dout = Din$ $i \leqq Din < m \rightarrow Dout = Din - 1$ $m \leqq Din < n \rightarrow Dout = Din - 2$ $Din \geqq n \rightarrow Dout = Din - 3$, ($2^M - 6 > n > m > l > 0$; $l$, $m$ and $n$ are integers);

a fourth group condition that may satisfy the following relationships:

$Din < l+1 \rightarrow Dout = Din$ $l+1 \leqq Din < m+1 \rightarrow Dout = Din - 1$ $m+1 \leqq Din < n+1 \rightarrow Dout = Din - 2$ $Din \geqq n+1 \rightarrow Dout = Din - 3$, ($2^M - 6 > n > m > l > 0$; $l$, $m$ and $n$ are integers);

a fifth group condition that may satisfy the following relationships:

$Din < l+2 \rightarrow Dout = Din$ $l+2 \leqq Din < m+2 \rightarrow Dout = Din - 1$ $m+2 \leqq Din < n+2 \rightarrow Dout = Din - 2$ $Din \geqq n+2 \rightarrow Dout = Din - 3$, ($2^M - 6 > n > m > l > 0$; $l$, $m$ and $n$ are integers);

and, a sixth group condition that may satisfy the following relationships, $Din < l+3 \rightarrow Dout = Din$ $l+3 \leqq Din < m+3 \rightarrow Dout = Din - 1$ $m+3 \leqq Din < n+3 \rightarrow Dout = Din - 2$ $Din \geqq n+3 \rightarrow Dout = Din - 3$, ($2^M - 6 > n > m > l > 0$; $l$, $m$ and $n$ are integers).

Output characteristics in which the output data may be standardized in a range from 0 to 100, and based on dithering of which the four frame group conditions (third-sixth) are applied, may be similar to the output characteristics illustrated in FIG. 8.

Figure 9:
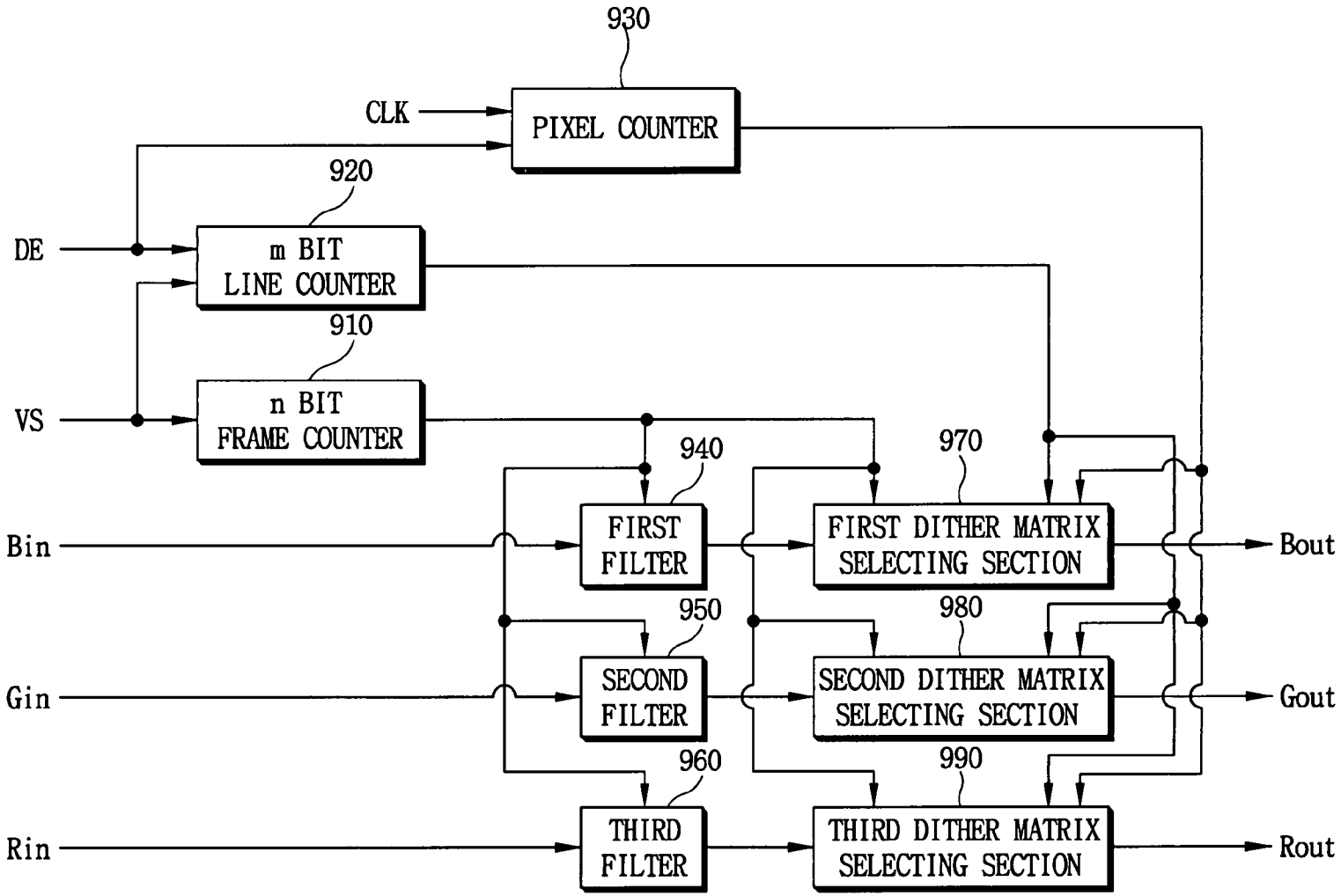
FIG. 9 is a block diagram illustrating a device for performing dithering according to an exemplary embodiment of the present invention.

FIG. 9 is a block diagram illustrating a dithering device according to an exemplary embodiment of the present invention.

Referring to FIG. 9, an apparatus for dithering may include a n-bit frame counter 910, a m-bit line counter 920, a pixel counter 930, first, second and third filters 940, 950 and 960, and first, second and third dither matrix selecting sections 970, 980 and 990.

The n-bit frame counter 910 may receive a vertical synchronization signal, which may be synchronized with a respective frame, and when the vertical synchronization signal has a high level or a low level, one frame may be outputted to a display screen.

A 1-bit frame counter may be required for two continuous frames, that may be selected to perform a dithering operation. A 2-bit frame counter may be required for four continuous that may be selected to perform a dithering operation. An output of the n-bit frame counter 910 for example, may be used for temporal compensation.

The m-bit line counter 920 may count the pixel lines of a frame based on a data enable signal (DE) and/or a vertical synchronization signal (VS). Pixel lines may have for example, about 768 lines in an extended graphics adaptor-type LCD (XGA), and about 1024 lines in a super XGA-type LCD (SXGA). A data enable signal may maintain a high state or a low state, and an input data signal may be outputted to a single pixel line of a frame.

The output of the line counter may be used for computing spatial compensation, for example when one dither matrix requires four pixel lines, a 2-bit line counter may be required, and when one dither matrix needs 2 pixel lines, a 1-bit line counter may be required.

Pixel counter 930 may count pixels of respective pixel lines based on a system clock (CLK) and a data enable signal (DE). A XGA-type LCD may have for example, 1024 pixels per line, thus requiring the pixel counter 930 to output a parallel 10-bit signal. For example, if a 2×4 dither matrix is used, a 1-bit line counter may be required to count for two lines, and 2 LSBs from the output of the pixel counter 930, may be required for designating two odd-numbered pixels and two even-numbered pixels.

A 4×2 dither matrix may require a 2-bit line counter to count for four lines, and '1' LSB output of the pixel counter 930, may be required to designate an odd-numbered pixel and/or an even-numbered pixel.

The first, second and third filters 940, 950 and 960 may perform filtering based on input signals Rin, Gin and Bin, according to an exemplary embodiment of FIG. 9. An output of the n-bit frame counter 910 may be a control signal for the first, second and/or third filters 940, 950 and 960. Therefore, when the output of the frame counter is a 2-bit signal, the frame group conditions may be applied to four continuous frames.

The first, second and third filters 940, 950, and 960 may for example, filter respective M-bit data based on frame group conditions. The M-bit data may for example, have 8 bits, 10 bits, or more. The frame group conditions may include input data which decreases by a decimal value of '3' when an M-bit data has a gray scale corresponding to a high level of brightness, and may include an input data which decreases by a decimal value 0, 1, or 2 when one of the M-bit input data has a gray scale corresponding to a low level of brightness.

The frame group conditions may contain four subsections or more, depending on the gray scale and the corresponding level of brightness. A bit value of one of the input signals may decrease by a decimal value of 0, 1, 2 or 3 in proportion to the respective level of brightness in the corresponding subsections.

Dither matrix selecting sections 970, 980 and 990, according to an exemplary embodiment of FIG. 9, may receive signals filtered by corresponding first, second and third filters 940, 950 and 960 based on the frame group conditions, and specified bits output from the n-bit frame counter 910. Specified bits output from pixel counter 930 and/or the m-bit line counter 920 may provide control signals for dither matrix selecting sections 970, 980 and 990.

The dither matrix selecting sections 970, 980 and 990 may select pixel lines and/or odd-numbered or even-numbered pixels in a dither matrix based on the control signals. Temporal/spatial compensation may be performed on selected pixel(s) in a dither matrix.

A weight of '0' or '1' may be added to a M-2 bit reference gray scale value of a dither matrix for continuous frames based on the lower two bit data of the filtered M-bit data output from the filters 940, 950 and 960, for example, according to temporal compensation. A reference form of the dither matrix may be obtained and/or a horizontal mirroring or vertical mirroring process applied to the reference form based on the spatial compensation.

When frame group conditions are applied to input data, saturation may not occur at the gray scales corresponding to a high level of brightness, and when temporal/spatial compensation is used, whole gray scales may be expressed with an acceptable level.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of dithering comprising:

selecting a frame on which dithering will be performed;

filtering M1 bit data based on at least two frame group conditions to represent a gray scale with M2 bits, where M2 being obtained by subtracting N from M1 ;

selecting an upper M2 bits from the filtered M1 bit data to represent a reference gray scale value;

selecting a dither matrix for the selected frame; and performing a temporal compensation or a spatial compensation on the selected dither matrix based on lower N bits of the filtered M1 bit data, wherein N is not 0 bits.

2. The method of claim 1, wherein M1 represents 8 or 10 bits, and N represents 2 bits.

3. The method of claim 1, wherein the M1 bit data are decreased by a decimal value 3 when the M1 bit data have a gray scale corresponding to a high level of brightness, and where the M1 bit data are decreased by a decimal value of less than 2 when the M1 bit data have a gray scale corresponding to a low level of brightness.

4. The method of claim 3, wherein the two frame group conditions including a first frame group condition and a second frame group condition, includes the first frame group condition satisfying the following relationships:

$$Dout=Din-3 \text{ when } Din>g;$$

$$Dout=Din-2 \text{ when } g\geqq Din>h;$$

$$Dout=Din \text{ when } Din\leqq h; \text{ for } 2^{M1}-4>g>h>0;$$

where g and h are integers;

wherein Dout is produced based on Din, where Din is a decimal value corresponding to a binary value based on the M1 bit data; and wherein the second frame group condition satisfies the following relationships:

$$Dout=Din-3 \text{ when } Din>g;$$

$$Dout=2 \text{ when } g\geqq Din>h;$$

$$Dout=0 \text{ when } Din\leqq h; \text{ for } 2^{M1}-4>g>h>0.$$

5. The method of claim 4, wherein the M1 bit data corresponding to first at least two frames are filtered based on the first frame group condition during a time period corresponding to the first at least two frames; and wherein the M1 bit data corresponding to second at least two frames are filtered based on the second frame group condition during a time period corresponding to the second at least two frames following the first at least two frames.

6. The method of claim 4, wherein the M1 bit data corresponding to first four frames are filtered based on the first frame group condition during a time period corresponding to the first four frames; and wherein the M1 bit data corresponding to second four frames, which are filtered based on the second frame group condition during a time period corresponding to the second four frames following the first four frames.

7. The method of claim 1, wherein the two frame group conditions have four subsections which correspond to a gray scale based on a level of brightness, and the M1 bit data decreases by a decimal value in proportion to the level of brightness represented by the respective subsections.

8. The method of claim 7, wherein the at least two frame group conditions further include a third frame group condition and a fourth frame group condition, where the third frame group condition satisfies the following relationships:

$$Dout=Din \text{ when } Din<i;$$

$$Dout=Din-1 \text{ when } i\leqq Din<j;$$

$$Dout=Din-2 \text{ when } j\leqq Din<k;$$

$Dout=Din-3 Din \geqq k$; for $2^M-4>k>j>i>0$;

where i, j, and k are integers;

wherein Dout is produced based on Din, where Din is a decimal value corresponding to a binary value based on the M1 bit data; and wherein the fourth frame group condition satisfies the following relationships:

$Dout=Din$ when $Din<i+1$;

$Dout=Din-1$ when $i+1 \leqq Din<j+1$;

$Dout=Din-2$ when $j+1 \leqq Din<k+1$;

$Dout=Din-3$ when $Din \geqq k+1$; for $2^M-4>k>j>I>0$.

9. The method of claim 8, wherein the M1 bit data corresponding to first at least two frames are filtered based on the third frame group condition during a time period corresponding to the first at least two frames; and wherein the M1 bit data corresponding to second at least two frames are filtered based on the fourth frame group condition during a time period corresponding to the second at least two frames.

10. The method of claim 8, wherein the M1 bit data corresponding to first four frames are filtered based on the third frame group condition during a time period corresponding to the first four frames; and wherein the M1 bit data corresponding to second four frames are filtered based on the fourth frame group condition during a time period corresponding to the second four frames.

11. The method of claim 7, wherein the at least two frame group conditions include a fifth frame group condition, a sixth frame group condition, a seventh frame group condition and an eighth frame group condition, where the fifth frame group condition satisfies the following relationships:

$Dout=Din$ when $Din<l$;

$Dout=Din-1$ when $l \leqq Din<m$;

$Dout=Din-2$ when $m \leqq Din<n$;

$Dout=Din-3$ when $Din \geqq n$; for $2^{M1}-6>n>m>l>0$;

where 1, m and n are integers;

where the sixth frame group condition satisfies the following relationships:

$Dout=Din$ when $Din<l+1$;

$Dout=Din-1$ when $l+1 \leqq Din<m+1$;

$Dout=Din-2$ when $m+1 \leqq Din<n+1$;

$Dout=Din-3$ when $Din \geqq n+1$; for $2^{M1}-6>n>m>l>0$;

where the seventh frame group condition satisfies the following relationships:

$Dout=Din$ when $Din<l+2$;

$Dout=Din-1$ when $l+2 \leqq Din<m+2$;

$Dout=Din-2$ when $m+2 \leqq Din<n+2$;

$Dout=Din-3$ $Din \geqq n+2$; for $2^{M1}-6>n>m>l>0$;

and where the eighth frame group condition satisfies the following relationships:

$Dout=Din$ when $Din<l+3$;

$Dout=Din-1$ when $l+3 \leqq Din<m+3$;

$Dout=Din-2$ when $m+3 \leqq Din<n+3$;

$Dout=Din-3$ when $Din \geqq n+3$; for $2^M-6>n>m>l>0$.

12. The method of claim 11, wherein the M1 bit data corresponding to first two first frames are filtered based on the fifth frame group condition during a time period corresponding to the first two frames, wherein the M1 bit data corresponding to second two frames are filtered based on the sixth frame group condition during a time period corresponding to the second two frames, wherein the M1 bit data corresponding to third two frames are filtered based on the seventh frame group condition during a time period corresponding to the third two frames, wherein the M1 bit data corresponding to fourth two frames are filtered based on the eighth frame group condition during a time period corresponding to the fourth two frames.

13. The method of claim 8, wherein the M1 bit data corresponding to first four frames are filtered based on the fifth frame group condition during a time period corresponding to the first four frames, wherein the M1 bit data corresponding to second four frames are filtered based on the sixth frame group condition during a time period corresponding to the second four frames, wherein the M1 bit data corresponding to third four frames are filtered based on the seventh frame group condition during a time period corresponding to the third four frames, wherein the M1 bit data corresponding to fourth four frames are filtered based on the eighth frame group condition during a time period corresponding to the fourth four frames.

14. The method of claim 1, wherein selecting the dither matrix includes:

selecting a pixel line of a pixel on which the dithering is performed; and selecting an even-numbered pixel or an odd-numbered pixel.

15. The method of claim 1, wherein the dither matrix includes 8 pixels and has a form of 2 rows by 2 columns, or 4 rows by 2 columns.

16. The method of claim 1, wherein performing a temporal compensation or a spatial compensation on the dither matrix includes:

performing a temporal compensation by adding a weight of '0' or '1' to the reference gray scale value of the dither matrix based on lower two bits of the filtered M1 bit data; and obtaining a reference form of the dither matrix to perform a spatial compensation by applying horizontal mirroring or a vertical mirroring to the reference form.

17. The method of claim 16, wherein, based on the temporal compensation, the reference gray scale value is outputted without change when the lower two bits are equal to a binary value '00'; and the reference gray scale value of a data line of a corresponding pixel in a frame among continuous four frames increases by one when the lower two bits are equal to a binary value '01', and the reference gray scale value of a data line of a corresponding pixel in two frames among the continuous four frames increases by one when the lower two bits are equal to a binary value '10'; and the reference gray scale value of a data line of a corresponding pixel in three frames of the continuous four frames increases by one when the lower two bits are equal to a binary value '11'.

18. The method of claim 16, wherein the reference form of the spatial compensation is obtained by assigning a weight to corresponding pixels in the dither matrix in an arbitrary frame among one selected frames to perform the temporal compensation.

19. The method of claim 16, wherein two among three data inputs provided to three corresponding data lines of a pixel are selected to perform the horizontal mirroring, which is applied to the reference form of the dither matrix.

20. The method of claim 19, wherein one among the three data inputs provided to three corresponding data lines of a pixel is selected to perform the vertical mirroring, which is applied to the reference form of the dither matrix.

21. The method of claim 16, wherein the reference form is outputted to two data lines of three data lines of a pixel during a time period corresponding to first four continuous frames, and horizontal mirroring is applied to the reference form to generate a horizontally mirrored form during a time period corresponding to second four second frames, and thus the reference form and the horizontally mirrored form are outputted alternately.

22. The method of claim 21, wherein the reference form is outputted to one data line of the three data lines of a pixel during a time period corresponding to first four continuous frames and vertical mirroring is applied to the reference form to generate a vertically mirrored form during a time period corresponding to second four frames, and thus the reference form and the vertically mirrored form are outputted alternately.

23. An apparatus for performing dithering comprising:

an n-bit frame counter for selecting continuous $2^n$ frames on which dithering is performed, and counting a vertical synchronization signal to select a dither matrix;

an m-bit line counter for counting a data enable signal based on the vertical synchronization signal, to select $2^m$ lines of the dither matrix on which a spatial compensation is performed;

at least one filter for filtering M1 bit data based on the data enable signal using at least two frame group conditions;

a pixel counter for selecting an odd-numbered pixel or an even-numbered pixel of the dither matrix based on a system clock and the data enable signal; and at least one dither matrix selecting section for performing the dithering on the filtered M1 bit data to obtain M2 bit data for representing a gray scale based on the filtered M1 bit data, an output of the n-bit frame counter, an output of the m-bit line counter and an output of the pixel counter, wherein the M2 bit data is fewer bits than the M1 bit data.

24. The apparatus of claim 23, wherein the at least one filter provides filtering for R(Red), G(Green) and B(Blue) types of input data.

25. The apparatus of claim 23, wherein M1 is equal to 8 or 10 bits.

26. The apparatus of claim 23, wherein the n bit frame counter includes a 1-bit frame counter for selecting two frames, or a 2-bit frame counter for selecting four frames.

27. The apparatus of claim 23, wherein the m bit line counter includes a 1-bit line counter for selecting two lines of the dither matrix.

28. The apparatus of claim 23, wherein the m bit line counter includes a 2-bit line counter for selecting four lines of the dither matrix.

29. The apparatus of claim 23, wherein the at least one filter operates according to the at least two frame group conditions, and a bit value of one of the M1 bit data decreases by a decimal value 3 when one of the M1 bits has a gray scale corresponding to a high level of brightness, and a bit value of one of the M1 bits decreases by a decimal value less than 2 when one of the M1 bits has a gray scale corresponding to a low level of brightness.

30. The apparatus of claim 23, wherein the filter operates according to the at least two frame group conditions, having four subsections depending on a gray scale and corresponding level of brightness, and where a bit value of one of the input data decreases by a decimal value 0, 1, 2 or 3 in proportion to the level of brightness in the four subsections.

31. The apparatus of claim 23, wherein the at least one dither matrix selecting section performs at least one of temporal compensation or spatial compensation on the selected dither matrix.

32. The apparatus of claim 31 wherein the temporal compensation or the spatial compensation for the selected dither matrix includes adding a weight of 0 or '1' to M-2 bit reference gray scale value of the dither matrix in continuous frames based on lower at least two bits of the filtered M1 bit data of the at least one filter, and includes determining a reference form of the dither matrix to apply a horizontal mirroring or a vertical mirroring to the reference form.

* * * * *